US006199523B1

(12) United States Patent
Neubauer et al.

(10) Patent No.: US 6,199,523 B1
(45) **Date of Patent: *Mar. 13, 2001**

(54) METHOD FOR REGULATING THE OPERATION OF AN ADJUSTING DEVICE

(75) Inventors: Dirk Neubauer, Nachrodt-Wiblingwerde; Dirk Heintzen, Hagen; Helmut Schilly, Bergneustadt; Harald Schmitz, Dortmund, all of (DE)

(73) Assignee: Aft Atlas Fahrzeugtechnik GmbH, Werdohl (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/637,761

(22) Filed: Aug. 11, 2000

Related U.S. Application Data

(62) Division of application No. 09/024,523, filed on Feb. 17, 1998, now Pat. No. 6,158,404.

(30) Foreign Application Priority Data

Feb. 26, 1997 (DE) ..... 197 07 627

(51) Int. Cl.[7] ..... F01L 13/00

(52) U.S. Cl. ..... 123/90.15; 123/90.17; 74/568 R; 464/2

(58) Field of Search ..... 123/90.15, 90.16, 123/90.17, 90.18, 90.31; 74/567, 568 R; 464/1, 2, 160, 161

(56) References Cited

U.S. PATENT DOCUMENTS

| | | | | |
|---|---|---|---|---|
| 5,138,291 | | 8/1992 | Day | 335/258 |
| 5,184,578 | | 2/1993 | Quinn, Jr. et al. | 123/90.17 |
| 5,197,508 | | 3/1993 | Göttling et al. | 137/1 |
| 5,245,968 | | 9/1993 | Kolias et al. | 123/414 |
| 5,271,360 | | 12/1993 | Kano | 123/90.17 |
| 5,435,782 | | 7/1995 | Tortul | 464/2 |
| 5,509,383 | | 4/1996 | Kahrs et al. | 123/90.12 |
| 5,611,304 | | 3/1997 | Shinojima | 123/90.15 |
| 5,657,671 | | 8/1997 | Morii | 74/568 |
| 5,666,914 | | 9/1997 | Ushida et al. | 123/90.17 |
| 5,669,343 | | 9/1997 | Adachi | 123/90.17 |
| 5,738,053 | * | 4/1998 | Kato | 123/90.15 |
| 5,775,279 | | 7/1998 | Ogawa et al. | 123/90.17 |

* cited by examiner

*Primary Examiner*—Weilun Lo
(74) *Attorney, Agent, or Firm*—Darby & Darby

(57) ABSTRACT

The phase of a camshaft in an internal combustion engine can be changed by the piston rod of a double-acting hydraulic cylinder and piston unit which is controlled by a valve having a spool movable axially by an electromagnet which is adapted to be influenced by a plurality of signals including those from the engine electronics.

9 Claims, 2 Drawing Sheets

METHOD FOR REGULATING THE OPERATION OF AN ADJUSTING DEVICE

This is a division, of application Ser. No. 09/024,523, filed Feb. 17, 1998 now U.S. Pat. No. 6,158,404. Each of these prior applications is hereby incorporated herein by reference, in its entirety.

BACKGROUND OF THE INVENTION

The invention relates to apparatus for selecting different positions of one or more phase selectors, such as the positions of an adjustable phase selector for a camshaft in the combustion engine of the power train in a motor vehicle.

The invention further relates to improvements in methods of selecting any one of a plurality of different positions of a least one adjustable phase selector, such as a phase selector for a camshaft in the combustion engine of the power train in a motor vehicle.

OBJECTS OF THE INVENTION

An object of the invention is to provide a novel and improved apparatus which can adjust one or more phase selectors in a space- and material-saving manner.

Another object of the invention is to provide a relatively simple and inexpensive apparatus which can be utilized with advantage in an internal combustion engine for motor vehicles to adjust the phase selector for a camshaft in the engine.

A further object of the invention is to provide an apparatus which comprises a relatively small number of simple, sturdy and inexpensive parts.

An additional object of the invention is to provide a novel and improved method which can be practiced with the above outlined apparatus and which is capable of compensating for potential functional deficiencies attributable to the relative simplicity of the apparatus.

Still another object of the invention is to provide a method which can be practiced by taking into consideration any desired practical number of variables capable of affecting the adjustment of a phase selector for a camshaft in a combustion engine.

A further object of the invention is to provide an engine with one or more camshafts adapted to be phase adjusted by an apparatus and in accordance with a method of the above outlined character.

An additional object of the invention is to provide a novel and improved combination of hydraulic (and/or electrical) and electromagnetic components for the adjustment of a reciprocable and/or otherwise movable phase selector for camshafts in the internal combustion engines of power trains in motor vehicles.

SUMMARY OF THE INVENTION

One feature of the invention resides in the provision of an apparatus for selecting any one of a plurality of different positions of an adjustable phase selector. Basically, the improved apparatus comprises at least one actuatable proportional hydraulic or electrical adjusting component for the phase selector, and a nonproportional actuator component for the adjusting component.

The phase selector can be arranged to assume an infinite number of different positions (such as the positions of a piston in the cylinder of a double-acting fluid-operated cylinder and piston unit) and to select the phase of an adjustable camshaft in an internal combustion engine forming part of a power train in a motor vehicle.

The actuator component can include or constitute a switching electromagnet.

Alternatively, the actuator component can include or constitute a lifting electromagnet.

The at least one adjusting component can exhibit a shifting characteristic or a proportional characteristic.

The improved apparatus can be constructed and assembled in such a way that the at least one adjusting component is movable between two end positions (for example, the spool of a hydraulic valve which embodies the at least one adjusting component can be installed for such movement in the body of the valve) and through a plurality of intermediate positions between the two end positions. Such at least one adjusting component can exhibit a shifting characteristic in each of its end positions and a proportional characteristic in at least some of its intermediate positions.

Alternatively, the at least one adjusting component can be installed for movement between two end positions and through a plurality of intermediate positions disposed between the two end positions and including at least one first intermediate position adjacent each of the end positions and a plurality of additional intermediate positions between the first intermediate positions. Such at least one adjusting component can exhibit a shifting characteristic in each of its first intermediate positions (i.e., close to the respective end positions) and a proportional characteristic in at least some of the additional intermediate positions.

The arrangement can be such that the phase selector is adjustable by a plurality of hydraulic or electrical adjusting components.

Another feature of the present invention resides in the provision of a novel and improved method of selecting any one of a plurality of different positions of an adjustable phase selector. The method comprises the steps of adjusting the phase selector with at least one actuatable normally proportional hydraulic or electrical adjusting component, actuating the at least one adjusting component by a normally linear nonproportional actuating component, and utilizing at least one auxiliary function to compensate for at least one of (a) absence of proportionality of the at least one adjusting component, and (b) absence of linearity of the actuating component.

The method can further comprise one of the presently preferred applications of the selector, namely the step of utilizing the phase selector for adjustments of the phase of an adjustable crankshaft in the internal combustion engine of a motor vehicle.

The utilizing step can include at least intermittently (or continuously) determining the extent of departure from the normal proportionality of the at least one adjusting component and/or the extent of departure from normal linearity of the actuating component, and utilizing the thus determined or obtained information to select the extent of compensation for the absence of proportionality and/or for the absence of linearity.

The at least one adjusting component can be selected and mounted in such a way that it can assume a plurality of positions in which it exhibits a shifting characteristic; the auxiliary function of the method of adjusting the phase selector with an adjusting component of the just outlined character can include a determination of the positions of the at least one adjusting component (i.e., of those positions in which such adjusting component exhibits a shifting characteristic).

Alternatively, the at least one adjusting component can have a plurality of positions in which such adjusting component exhibits a proportional characteristic; the auxiliary function of the method according to which the phase selector is adjustable by such an adjusting component can include a determination of the positions of the at least one adjusting component.

The at least one adjusting component can assume a predetermined position in which the phase selector is maintained in an unchanging position; the auxiliary function of the method which can be practiced with such apparatus can include the step of determining the predetermined position of the at least one adjusting component. Such auxiliary function can further include the step of continuously conforming the position of at least one of the adjusting and actuating components to the unchanging position of the phase selector.

The arrangement can be such that the phase selector is adjustable at a plurality of speeds. The auxiliary function of the method which is being practiced with an apparatus for the adjustment of such phase selector can include the step of determining the speed of the phase selector during adjustment and the step of selecting the duration of adjustment of the phase selector as a function of the determined speed.

The novel features which are considered as characteristic of the invention are set forth in particular in the appended claims. The improved apparatus itself, however, both as to its construction, its mode of operation and the method of utilizing the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
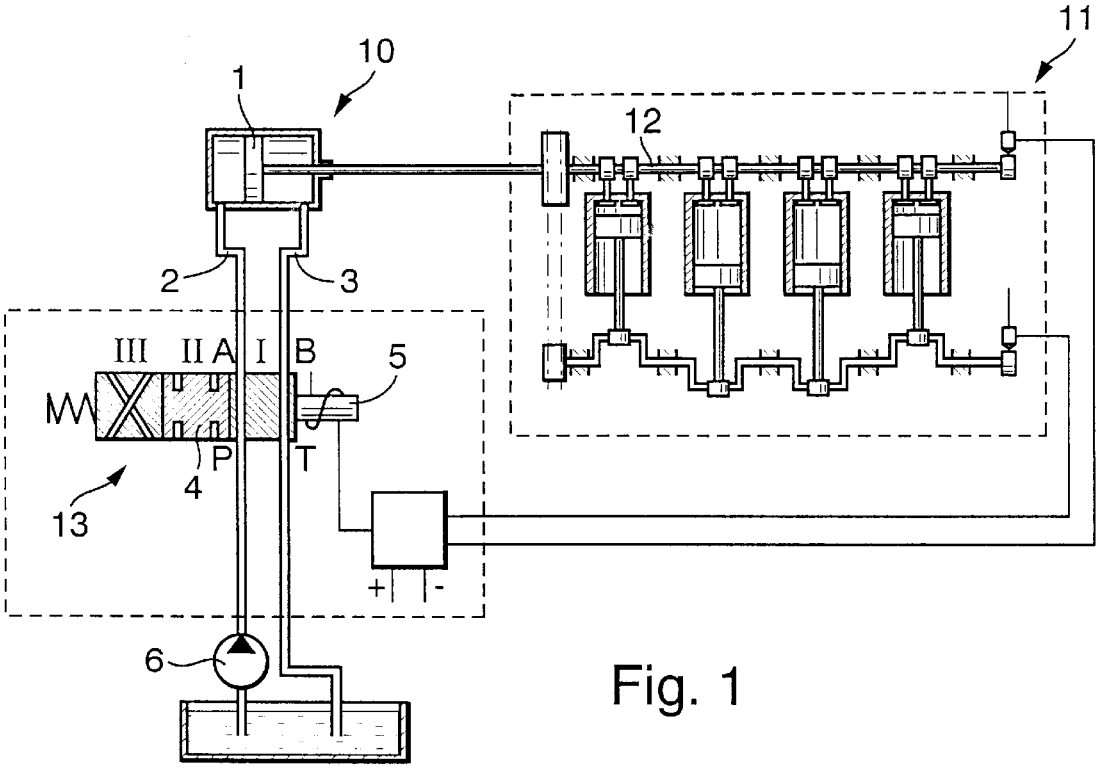
FIG. 1 is a schematic partly elevational and partly sectional view of an internal combustion engine and of an apparatus which embodies one form of the invention and is utilized to select the phase of a camshaft in the engine.
Figure 2:
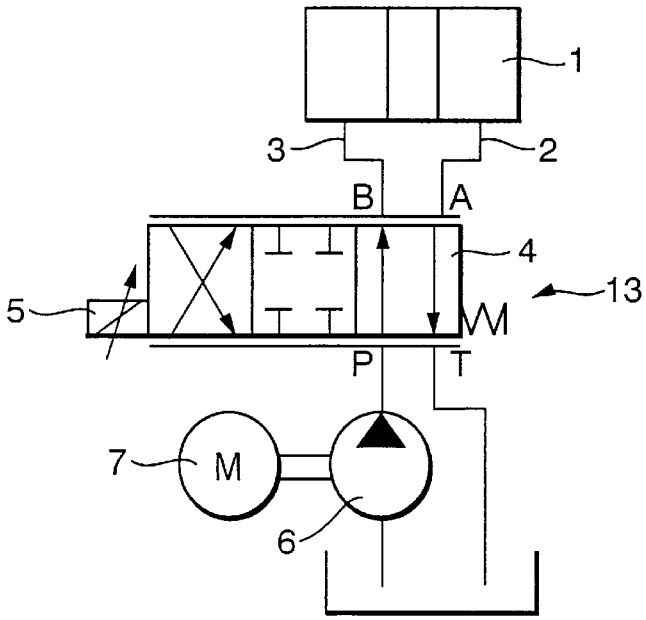
FIG. 2 is a fragmentary schematic view of a slightly modified apparatus and further shows a motor for the source of pressurized hydraulic fluid which is utilized in the adjustable phase selector and in an adjusting component for such phase selector.

FIGS. 1 and 2 show certain relevant details of an apparatus 10 which is designed to select any one of a plurality of different positions of an adjustable phase selector 1 for the camshaft 12 (or for one of several camshafts) forming part of an internal combustion engine 11 in the power train of a motor vehicle. A detailed description of the purposes and certain presently known modes of phase shifting one or more camshafts in an internal combustion engine can be found in U.S. Pat. Nos. 5,184,578 (Quinn, Jr. et al.) and 5,245,968 (Kolias et al.) the disclosures of which are incorporated herein by reference.

The phase adjuster 1 is positionable or adjustable, preferably infinitely or continuously (i.e., whenever necessary) by an adjusting element 13. The latter can constitute a hydraulic or (as actually shown) an electro-hydraulic adjusting element in the form of a valve. The illustrated adjusting: element (valve) 13 comprises a proportional hydraulic component or part 4 and a nonproportional electromagnetic component or part 5. The operative connection between the hydraulic component 4 and the hydraulic phase selector 1 (such as a double-acting hydraulic cylinder and piston unit having a piston rod connected to the camshaft, or to the camshafts, 12 of the internal combustion engine 11) comprises two fluid conveying conduits 2 and 3. The illustrated valve 13 is a multiported slide valve including a spool (4) movable against the resistance or under the bias of a suitable spring in response to energization or deenergization of the electromagnetic component (5).

The electromagnetic component 5 is installed in a closed loop circuit. This component can be said to constitute an actuator, i.e., a device that performs an action or outputs a signal in response to a signal from a computer. The illustrated nonproportional component 5 is or comprises a solenoid (switching or driving magnet) or a lifting (crane) magnet.

The hydraulic component 4 of the valve 13 exhibits a shifting characteristic which can effect a shifting between at least two positions but does not shift into any intermediate positions. Alternatively, the hydraulic component 4 can exhibit a proportional characteristic, i.e., it can select intermediate positions between certain preselected (such as end) positions. For example, the hydraulic component 4 can be designed for movement between two end positions, in each of which it exhibits a shifting characteristic, as well as to a plurality of intermediate positions which are located between the two end positions and in each of which the component 4 exhibits a proportional characteristic. It is also possible to employ a hydraulic adjusting component 4 movable between two end positions and exhibiting shifting characteristics close to each of the two end positions, and to a plurality of (additional) intermediate positions (located between those intermediate positions in which the component 4 exhibits shifting characteristics) in which the component 4 exhibits a proportional characteristic.

The apparatus 10 can comprise two or more valves 13 or analogous means for effecting a practically infinite number of adjustments of the phase selector 1.

The method which is to be carried out by resorting to the structure shown in FIG. 1 can be practiced to effect a positioning or adjustment of the phase selector 1 to an infinite number of different positions or conditions whereby the illustrated selector 1 determines the phase of the camshaft(s) 12 accordingly. As already mentioned above, the proportional hydraulic component 4 of the valve 13 controls the phase selector 1 and is controlled by the circuit including the nonproportional electromagnetic component 5. It is to be noted that the illustrated hydraulic component 4 can be replaced with an electrical component without departing from the spirit of the invention.

The method of the present invention involves resort to auxiliary functions in order to compensate for nonproportionality or nonlinearity of the hydraulic or electrical adjusting element or component. It is of advantage if an auxiliary function to compensate for a nonlinearity or nonproportionality of the hydraulic or electrical component (4) involves an at least temporary (such as sporadic or intermitent) or a continuous learning (determination or detection or monitoring) of the departure or deviation from the proportionality or linearity.

It is equally advisable or advantageous to resort to an auxiliary function which recognizes and ascertains and (if necessary) memorizes those positions or ranges of positions of the adjusting component (such as 4) which are relevant for the adjustment of the phase selector (1).

In accordance with a further embodiment of the improved method, one can resort to an auxiliary function arranged to ascertain those positions of the adjusting component (such as 4) which are characteristic of the proportionality.

Still further, the method can involve resort to an auxiliary function which includes the recognition or determination of that position or condition of the valve 13 in which the phase selector 1 is maintained in a fixed position.

In accordance with another presently preferred embodiment which constitutes a modification or further development of the just described embodiment of the method, the auxiliary function involves the recognition or determination of that position or condition of the valve 13 (or of equivalent means for adjusting the phase selector 1) in which the position of the phase selector remains unchanged and minor influencing or interference suffices to ensure that the position of the phase selector continues to conform to the control signal from the adjusting component.

In accordance with still another embodiment, one can resort to an auxiliary function which is dependent upon the monitored speed of movement of one or more parts of the phase selector 1 and transmits corresponding signals serving to determine the duration of adjustment of the phase selector by the component 4 of the valve 13.

The valve 13 receives hydraulic energy from a suitable source. FIG. 2 illustrates a pump 6 which can draw a hydraulic fluid (such as oil) from a suitable source (e.g., a sump) and supplies it to the selected chamber of the phase selector 1 via component 4 and conduits 2 or 3. The pump 6 is driven by a prime mover 7, e.g., an electric motor. It is also possible to employ an energy source in the form of an accumulator in addition to or in lieu of the pump 6.

The means for regulating the operation of the apparatus 10 further comprises suitable regulator means, such as one or more PID regulators, one or more prediction regulators and/or others. Such regulator or regulators is or are connected in the circuit of the electromagnetic component 5. As already mentioned above, the valve 13 can include a proportional hydraulic component 4 and a nonproportional electromagnetic component or actuator 5 which is connected in a circuit including one or more regulators. The operation of the circuit can take place with adaptive functions within a closed loop or along an open control path, preferably in such a way that the mobile component can assume any desired intermediate position between two end positions. The regulating operation is carried out by a suitable control unit or regulating unit for the closed loop or for the open control path.

The above outlined mode of operation renders it possible to regulate or control a hydraulic phase selector (1) or a servomotor (not shown) by resorting to a proportional hydraulic component (4), a nonproportional (such as electromagnetic) actuator (5) for the hydraulic component, and adaptive auxiliary functions in the regulating or control operation of the electronic regulating system.

The auxiliary functions can compensate for functional deficiencies or deficits of the regulating or control operation. For example, the auxiliary functions ascertain a lack of proportionality by means of a value which is being updated continuously or practically continuously. This ensures that the actual regulating operation is supplied with and can be influenced by a correction value for the calculation or another determination of values, such as a regulated quantity or correcting variable. This, in turn, renders it possible to select any desired adjustment angle or another parameter for the adjusting means (13) or for the phase selector (1) in accordance with the regulating method being practiced by the control unit including the component 5 or an equivalent actuator.

The phase selector 1 of FIGS. 1 and 2 is a double-acting cylinder and piston unit. FIG. 1 illustrates the spool (adjusting component) 4 of the valve 13 in an axial position (I) in which the piston of the phase selector 1 is being moved in a direction to the right, i.e., the conduit 2 supplies pressurized hydraulic fluid from the outlet of the pump 6 into the left-hand chamber of the cylinder, and the conduit 3 conveys a stream of fluid from the right-hand chamber of the cylinder to the sump.

When the spool of the component 4 assumes the median position II, those portions of the conduits 2, 3 which communicate with the chambers of the cylinder of the phase selector 1 are sealed from the pump 6 and from the sump. This ensures that the piston of the phase selector 1 remains in its previously selected axial position.

The piston of the phase selector 1 is caused to move in a direction to the left (as viewed in FIG. 1) when the spool (component 4) of the valve 13 is moved to the position III, i.e., the pump 6 supplies pressurized fluid into the right-hand cylinder chamber (via conduit 3) and the conduit 2 supplies fluid into the sump.

Figure 3:
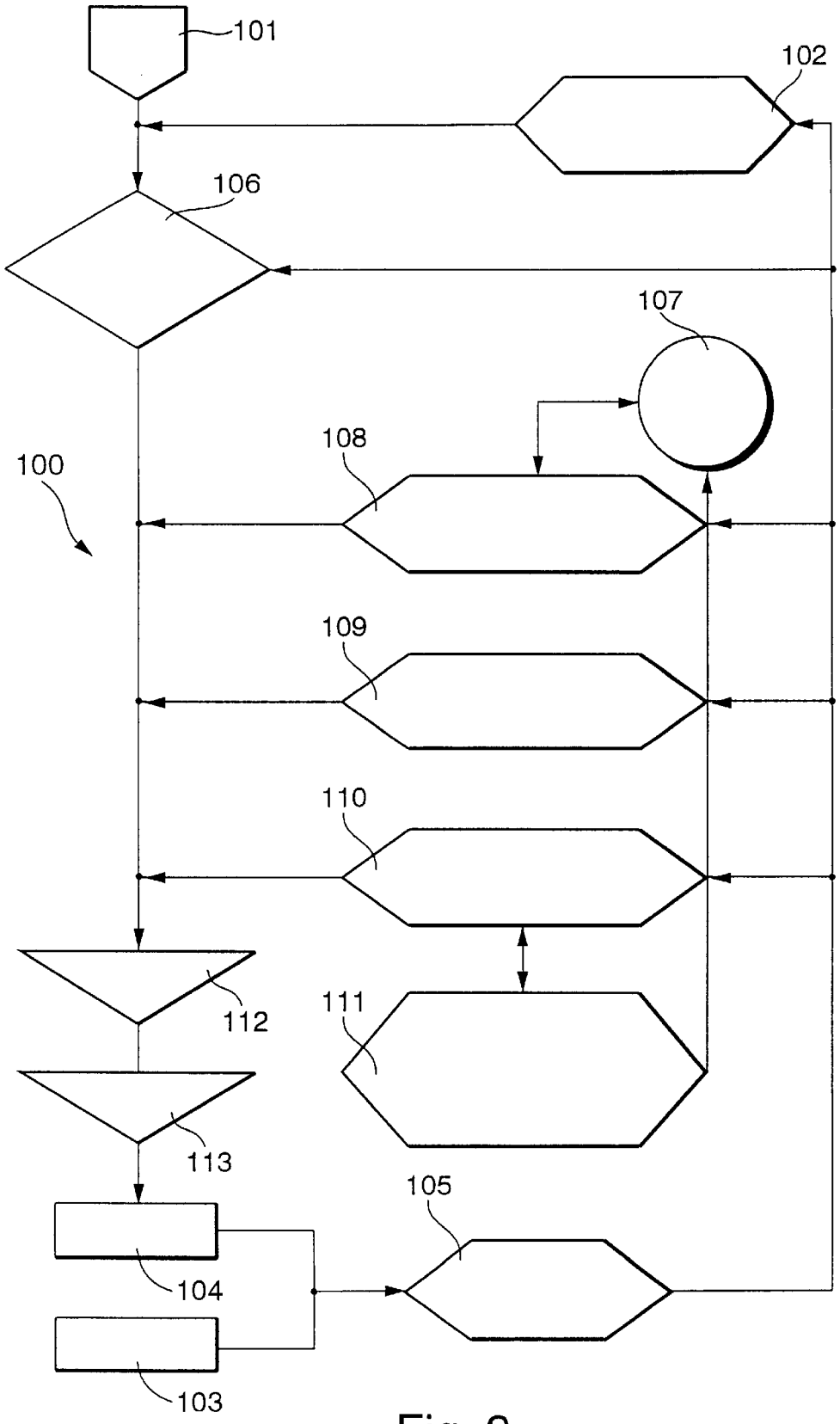
FIG. 3 is a block diagram of one routine of utilizing the apparatus for the practice of the improved method.

Referring to the block diagram 100 of FIG. 3, a phase selecting routine is started at 101. When the internal combustion engine (such as the engine 11 of FIG. 1) is started and is running, the electronic control circuit 102 for the engine (such control circuit comprises customary memories and a customary microprocessor) supplies a signal "alpha-soll" (desired alpha) which is a function of engine RPM n, load Md and, if necessary or desired, one or more additional parameters (i.e., alpha-soll =f (n, Md, . . . ). The value "alpha-soll" is fed into the algorithm of the regulator for the phase selector (shown at 113 in FIG. 3).

The angular positions of the camshaft (104 in FIG. 3) and of the crankshaft (103 in FIG. 3) of the engine are monitored by suitable sensors (shown in FIG. 1), and the signals from such sensors are processed at 105 to furnish a signal "alpha ist" (actual alpha) which is indicative of the momentary angular position of the camshaft 104 relative to the crankshaft 103. The signal "alpha-ist" is a function of the time differential (delta t) between the crankshaft and the camshaft in accordance with the following equation:

$$\text{"alpha-ist"} = n/5 * \text{delta t}.$$

A regulator (block 106) generates control signals PWM denoting the difference between "alpha-soll" and "alpha-ist", and the signals "delta-alpha"=PWM are transmitted to the actuator 112. The signals PWM are indicative of the intensity (such as speed) and duration of adjustment of the phase selector 113 by the actuator 112.

A table or a characteristic field is utilized to memorize or store the signals "delta-alpha"=PWM, i.e., signals denoting the relationship between the duration of adjustment of the phase selector 113 by the actuator 112 and the thus achievable phase adjustment. Such information can be retrieved from the table or the characteristic field (see the block 108). The information is actualized, either continuously or at selected intervals, as a result of check-back and comparison, and is stored in a memory 107; the latter can further serve for the storage of starting or basic values. The ascertained values serve to properly select the duration of adjustment of the phase selector 113 by the actuator 112.

A correction for nonlinearity of the adjusting element is carried out by resorting to an idealized characteristic curve which is stored in a memory. The block 109 denotes the step of ascertaining whether or not a phase adjustment as a result of the selected extent of adjustment departs from the ideal or optimal curve or value. The extent of deviation is stored in the memory and is considered in the course of the next-following adjustment or change.

The correction function further contains information concerning the regions or ranges of more and less pronounced resolution, for example, such as are attributable to different slopes of the characteristic curve. The thus ascertained values are utilized to conform and/or to correct the extent of adjustment of the phase selector 113.

When a regulator ascertains that the resolution is zero, for example, that it can merely discriminate between two points of clearly different adjustment speeds, this denotes that such regulator has located the boundary between the proportional range and the shifting range. Such item or items of information is or are memorized (see the block 111) because a correction or compensation for lack of linearity within the adjusting or selecting range is not absolutely necessary.

A conformance of a stable position takes place when the phase selector 113 is held in a particular position and no adjustment is desired (note the block 110). If the phase selector 113 continues to carry out a certain movement, the holding position of the actuator 112 is caused to conform by carrying out relatively small stepwise movements.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of adjusting phase selectors for camshafts or the like and, therefore, such adaptations should and are intended to be comprehended within the meaning and range of equivalence of the appended claims.

What is claimed is:

1. A method of selecting any one of a plurality of different positions of an adjustable phase selector, comprising the steps of adjusting the phase selector with at least one actuatable normally proportional hydraulic adjusting component; actuating the at least one adjusting component by a normally linear nonproportional actuating component; and utilizing at least one auxiliary function to compensate for at least one of (a) absence of proportionality of the at least one adjusting component and (b) absence of linearity of the actuating component.

2. The method of claim 1, further comprising the step of utilizing the phase selector for adjustments of the phase of an adjustable crankshaft in a combustion engine.

3. The method of claim 1, wherein said utilizing step includes at least intermittently determining the extent of departure from at least one of normal proportionality and normal linearity of the respective components and utilizing the thus determined information to select the extent of compensation.

4. The method of claim 3, wherein said utilizing step includes continuously determining the extent of said departure.

5. The method of claim 1, wherein the at least one adjusting component has a plurality of positions in which the at least one adjusting component exhibits a shifting characteristic and said auxiliary function includes a determination of said positions of the at least one adjusting component.

6. The method of claim 1, wherein the at least one adjusting component has a plurality of positions in which the at least one adjusting component exhibits a proportional characteristic and said auxiliary function includes a determination of said positions of the at least one adjusting component.

7. The method of claim 1, wherein the at least one adjusting component has a predetermined position in which the phase selector is maintained in an unchanging position and said auxiliary function includes a determination of said predetermined position of the at least one adjusting component.

8. The method of claim 7, wherein said auxiliary function further includes a continuous conforming of the position of at least one of the adjusting and actuating components to the unchanging position of the phase selector.

9. The method of claim 1, wherein the phase selector is adjustable at a plurality of speeds and said auxiliary function includes a determination of the speed of the phase selector and a selection of the duration of adjustment of the phase selector as a function of the determined speed.

* * * * *